United States Patent [19]

Luz

[11] 4,044,961

[45] Aug. 30, 1977

[54] MULTIPLE-UNIT SPOOLING MACHINE WITH YARN TRAVERSE MECHANISM

[75] Inventor: Rudolf Luz, Horgen, Switzerland

[73] Assignee: Maschinenfabrik Schweiter AG, Horgen, Switzerland

[21] Appl. No.: 663,675

[22] Filed: Mar. 4, 1976

[30] Foreign Application Priority Data

Mar. 26, 1975 Switzerland ..... 3912/75

[51] Int. Cl.[2] ..... B65H 54/20; B65H 54/28; B65H 54/38

[52] U.S. Cl. ..... 242/35.5 R; 242/18.1; 242/43 R; 242/43.1

[58] Field of Search ..... 242/35.5 R, 43 R, 43.1, 242/18 DD, 18 CS

[56] References Cited

U.S. PATENT DOCUMENTS 3,884,426 5/1975 Hermanns ..... 242/43.1

*Primary Examiner*—Stanley N. Gilreath
*Attorney, Agent, or Firm*—Flynn & Frishauf

[57] ABSTRACT

To permit isolation of individual spooling units from a multiple-unit machine, in case of necessity of repair or the like, a common drive shaft extends through the machine which has individual clutch units thereon, controlling rotation of respective gears which, in turn, transmit power to the individual spooling units, that is, to their traverse as well as to their drive elements. The drive elements, or at least portions thereof, form single replaceable units, preferably secured to the cover of an oil pan providing lubrication for the mechanism of the driving and spooling units, the clutches being operated by external engagement, for example by tightening down a pin securing the cover in place on the machine.

9 Claims, 4 Drawing Figures

MULTIPLE-UNIT SPOOLING MACHINE WITH YARN TRAVERSE MECHANISM

The present invention relates to spooling apparatus, especially for textile yarn or thread, and more particularly to multiple-head or multiple-unit spooling apparatus, each one having a traverse mechanism, the individual heads or units being driven by a master drive shaft common to the entire multiple-head machine.

Multiple-head spooling machines as used, for example, in the textile industry, are employed to wind thread or yarn delivered from other apparatus, for example from a texturizing machine, on spools, the wind-up speed being essentially constant. Machines of this type usually use a multiplicity of adjacently located spooling units, each having a yarn traverse mechanism, and all driven in unison by a common machine drive with which the spooling units are in fixed engagement.

In case of malfunction at any one of the spooling units, the entire multiple-head machine must be stopped to clear the difficulty or to replace a particular spooling head. This leads to inefficiency since the properly operating spooling units or heads are likewise out of production during interruption to clear malfunction of any one of the units.

It is an object of the present invention to provide a multiple-head spooling machine which is so constructed that individual units can be stopped, replaced or repaired without interfering with continued operation, and hence production of the remainder of the heads of the machine.

SUBJECT MATTER OF THE PRESENT INVENTION

Briefly, at least a portion of the traverse mechanism, preferably secured to a single carrier, for example the cover for the traverse mechanism itself, is a separate, removable unit; the rotational power transmission elements between the main common drive shaft of the machine and the individual units each include a clutch to selectively control rotational power transmission from the common drive shaft to the individual head and, more particularly, to the yarn traverse mechanism of the individual head forming part of the separable unit.

Malfunction at any one of the spooling heads of a multiple-head spooling machine can now be cleared without interrupting production at the remaining heads by operating the clutch to sever drive of the particular defective unit from the common drive shaft. The remaining heads or units are not influenced by this interruption. The defective unit can then be replaced or repaired.

In a preferred embodiment of the invention, each unit is located at least in part within an oil pan, which also surrounds the clutching arrangement between the main drive shaft and the driven elements of the specific unit. The removable unit includes the removable cover for the oil pan.

The clutch itself preferably is a disk clutch operated by a lever-type mechanism. The lever-type mechanism can easily be controlled by a pin or bolt secured to or adapted to be secured to the cover so that, when the cover is properly placed on the oil pan, the clutch is in engagement to provide drive power from the common shaft to the respective traverse mechanism. Preferably, the operating lever includes a mechanism to brake the driven element of the clutch when the clutch is disengaged.

The invention will be described by way of example with reference to the accompanying drawings, wherein.

Figure 1:
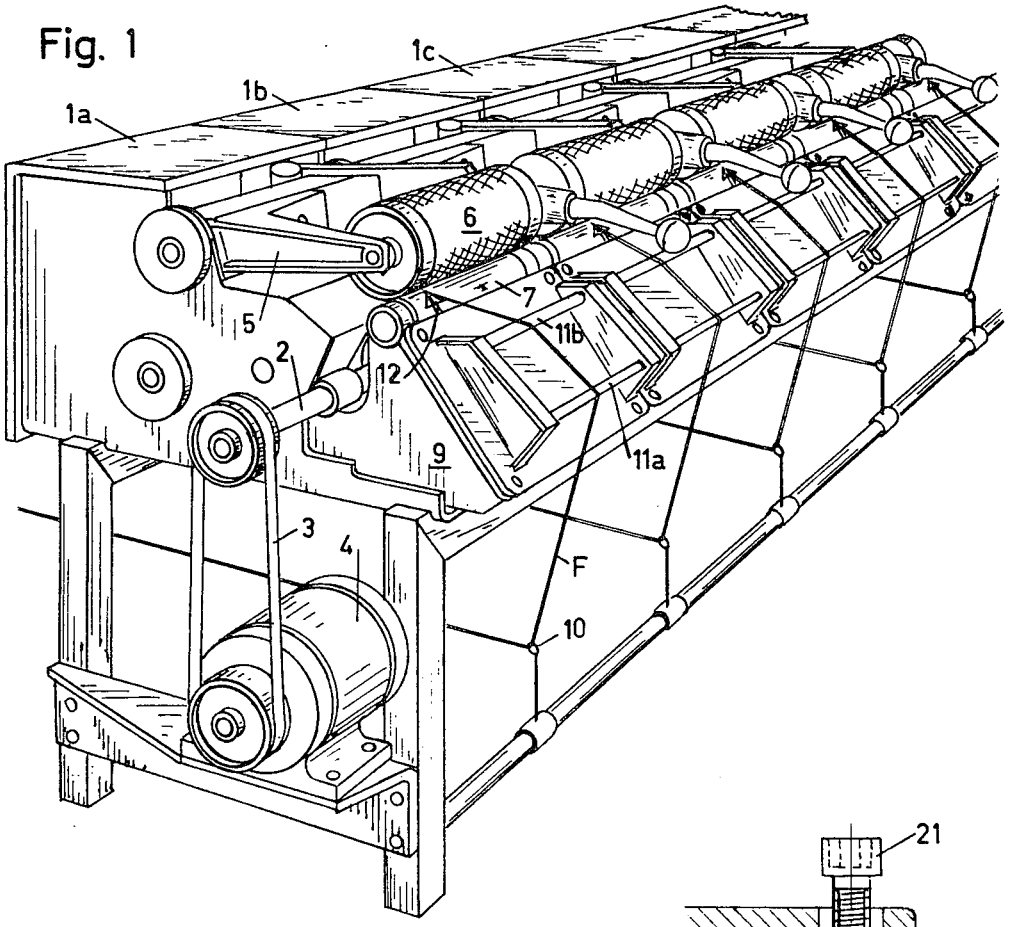
FIG. 1 is a perspective overall view of a multiple-head spooling machine.

The spooling machine illustrated in FIG. 1 includes a plurality of adjacently located spooling heads 1*a*, 1*b*, 1*c* . . . A main common drive shaft 2 passes through the spooling machine, drive shaft 2 being driven by a belt 3 from a motor 4. Each one of the spooling heads or units has a carrier arm 5 on which the yarn spool 6 is located. Yarn spool 6 is in circumferential, frictional engagement with a drive roller 7. The yarn traverse mechanism which guides the yarn laterally axially back and forth, associated with each one of the drive rollers 7, is located primarily in an oil pan 9. Yarn F is guided from a suitable textile machine (not shown) through a guide eye 10 over yarn guide rods 11*a*, 11*b* and through a traverse guide eye 12 to be spooled on spool 6.

Figure 2:
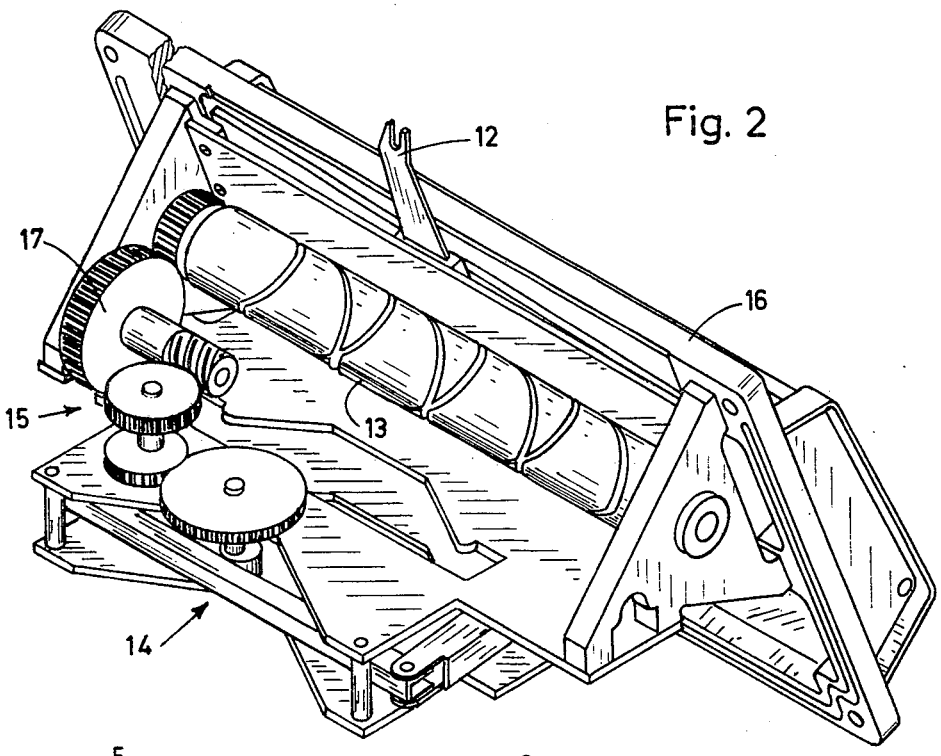
FIG. 2 is a perspective view of the cover and traverse mechanism, from the back thereof, of an individual spooling head or unit of the machine of FIG. 1.
Figure 3:
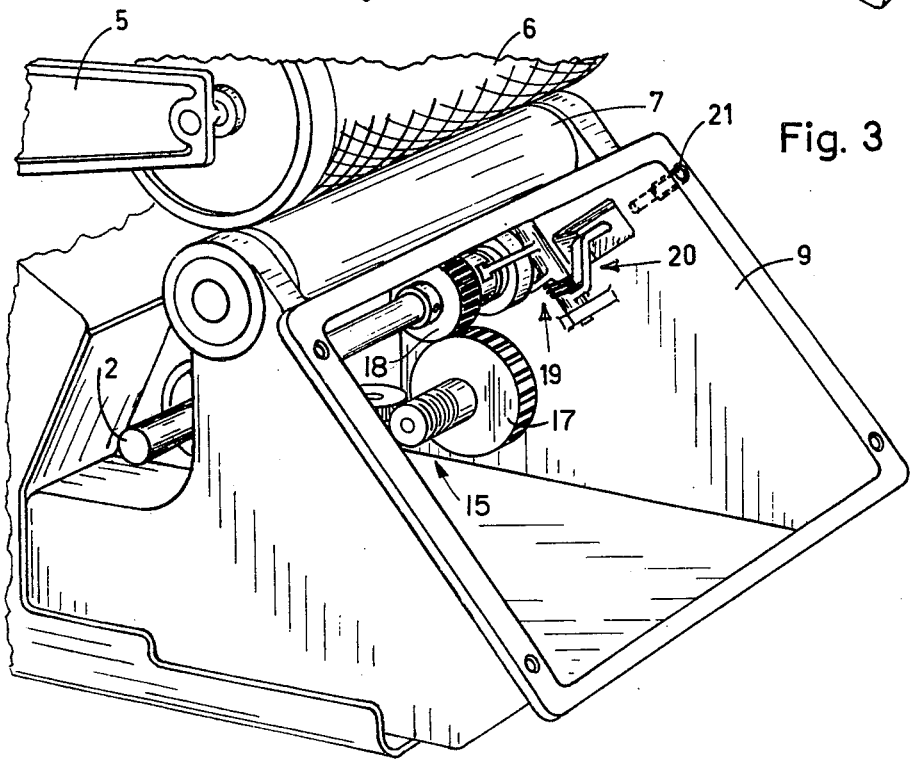
FIG. 3 is a perspective view from the front of a portion of the individual unit.

The traverse mechanism itself is best seen in FIGS. 2 and 3, and includes a double, reverse-spiral cylinder 13. A follower (not shown) engages in the double, reverse-spiral groove in the cylinder 13 for axial movement back and forth upon rotation of cylinder 13. An arrangement 14 is likewise provided, known per se, to prevent piling up of windings, constant pattern, or defective winding on the spool 6. A main drive gear 17 is driven from a main gear 18 on the main common shaft 2 (FIG. 3). A gearing 15 is geared to the winding control mechanism 14 and is driven by gear 17. A suitable control mechanism is shown in U.S. Pat. No. 3,764,090. The reverse-spiral cylinder 13 is driven from gear 17 (FIG. 2). The entire unit, including traverse guide eye 12, cylinder 13, winding control mechanism 14, gearing 15 and main drive gear 17, is mounted on a cover 16 of the oil pan 9 and forms a single replaceable assembly. Main drive gear 17 may further provide power to the roller 7, in circumferential engagement with the spool 6, or roller 7 can be driven separately. Main drive gear 17 thus may directly, or by means of furthur gears, be in rotational engagement with roller 7; such gears are usually located outside of the oil pan 9, although they may be journalled thereon. The shaft of drive gear 17 is in driven engagement with a gear 18 (FIG. 3) located on the main common shaft 2 by direct or indirect engagement over additional gears.

Gear 18, located on the shaft 2, forms a portion of a clutch mechanism 19, operated by an operating mechanism 20. The clutch 19 (FIG. 4) is formed by two clutch disks, one of which is secured to gear 18. Gear 18 is journalled for relative rotation with respect to shaft 2 by means of ball bearings 22. One clutch surface 23 is formed at an end face thereof. Radially, gear 18 is formed with a braking surface 24.

A driving clutch disk 25 cooperates with the clutching surface 23 on gear 18. Driving clutch disk 25 is secured for rotation with the shaft 2, while permitting axial movement with respect thereto, for example by means of a spline or key connection. A spring 26 tends to separate the clutch surfaces from each other. Upon movement of clutch disk 23 in axial direction to the left (FIG. 4), counter the force of spring 26, rotation will be transmitted from shaft 2 to gear 18 and hence to the traverse mechanism and to the spool wind-up roller 7.

Clutching and de-clutching, that is, engagement and disengagement of clutch 19, are effected by means of lever mechanism 20. Lever mechanism 20 can be operated externally by hand by moving operating lever 33. External operation of the operating mechanism 20, by hand, can be effected for example by a slot formed in the cover 16 and sealed, for example, by foam material, for insertion of a suitable tool such as a screwdriver. In accordance with a preferred embodiment, the clutch 19 is engaged or disengaged by a bolt 21 forming an operating pin which is screwed down or into engaging direction when the cover 16 is secured to the oil pan 9. This bolt, with its pin extension, simultaneously forms an attachment element for the cover 16.

Figure 4:
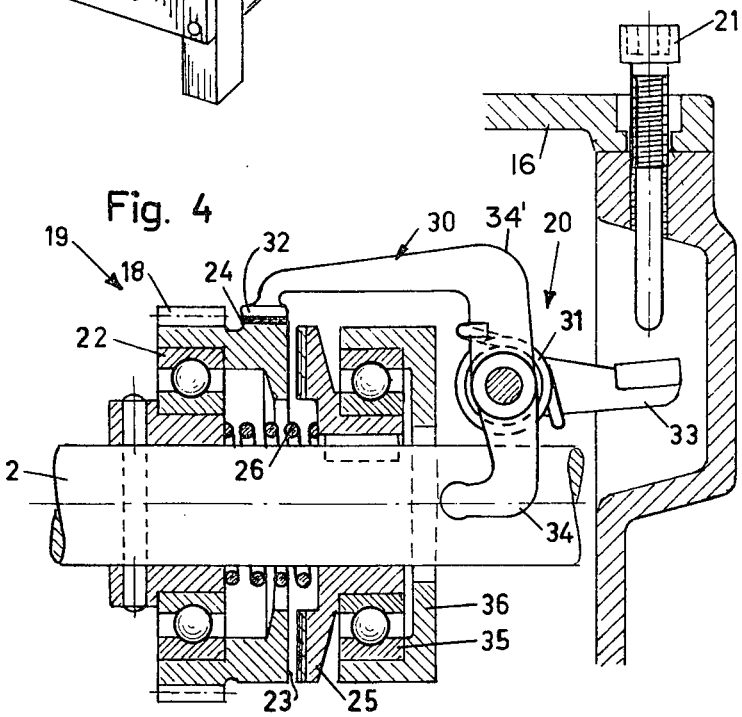
FIG. 4 is a longitudinal axial view, partly in section, illustrating the clutch-and-brake arrangement for an individual unit, and operating means therefor, in accordance with the present invention.

The operating mechanism 20 for the clutch 19 includes a double-arm lever 30 having arms 34 and 34'. Lever 30 is biassed to rotate in counter-clockwise direction by spring 26 which acts on coupling disk 25 which, in turn, is in engagement with a push disk 36 journalled by bearing 35 on disk 25. Push disk 36 is in engagement with arm 34 of the double-arm lever 30. When the clutch is in disengaged position — as shown in FIG. 4 — a braking pad 32 secured to arm 34' of the lever 30 engages the braking surface 24 of gear 18 to stop gear 18 and prevent its rotation. Upon screwing down of pin 21, lever 30 is rotated in clockwise direction and arm 34 will press coupling disk 25 by transmission of motion through the push disk 36 against the coupling surface 23 on gear 18. Simultaneously, arm 34' will release the braking surface between brake pad 32 and the surface 24 on gear 18. The operating lever 33 is located coaxially with lever 30 and carries along lever 30 when lever 33 is depressed, due to engagement of a strong spring 31 with both levers 30 and 33. The indirect engagement of lever 33 and lever 30 by the spring coupling 31 forms an elastic operating connection.

Malfunction of any one of the spooling units 1*a*, 1*b* . . . now no longer requires interruption of production of the entire machine, since the common drive shaft 2 no longer need be stopped. The respective defective spooling head or unit can be isolated from shaft 2 simply by removing cover 16, that is, by loosening a respective mounting bolt 21. The respective spooling unit is thus operationally disconnected from the drive shaft 2 while, simultaneously, the spooling drive is braked. The braking surface 24 and the braking pad 32, as well as the clutching surface 23, and disk 25, can be so constructed and matched to each other that, upon insertion of a new or properly operating element, engagement and startup are "soft" to provide for gentle re-starting and prevent excessive strain on the yarn filament F being wound on spool 6. The resilient engagement connection of lever 33 and spring 31 additionally contributes to such soft engagement.

Various changes and modifications may be made within the scope of the inventive concept.

I claim:

1. Multiple-head spooling machine having a plurality of spooling units (1*a*, 1*b*, 1*c* . . . ) located adjacent each other comprising a common drive shaft (2) for the spooling units of the spooling machine;

a plurality of main gears (18) on the common drive shaft (2), one each located to provide drive power for a respective spooling unit;

each spooling unit including a wind-up spool carrier (5) for locating a wind-up spool (6) thereon, means (7) to impart rotation to the wind-up spool (6), and a yarn traverse mechanism including gearing means therefore located in position to guide yarn in axially traversing movement across the spool (6);

a main gear on each unit located in rotation power transmission postion with the main gear (18) of the respective spooling unit and in engagement with said traverse gearing means to transfer rotational power from the main drive shaft (2) through the respective main gear (18) of the respective spooling unit to the traverse mechanism thereof;

and a plurality of soft engagement clutches (19), one each associated with a respective spooling unit to selectively control rotational power transmission from the common drive shaft (2) to the main gear of each of the respective spooling units and hence to the respective yarn traverse mechanisms, and wherein at least a portion of the traverse mechanism of each of the spooling units forms a single replaceable assembly.

2. Machine according to claim 1, wherein the clutch controls transmission of power from the shaft (2) to said main gear (18).

3. Machine according to claim 1, wherein the main gears (18) and said clutches (19), are adjacently located on said common drive shaft (2), said clutches selectively controlling transmission of power between the common drive shaft (2) and said main gears (18).

4. Machine according to claim 1, wherein the traverse mechanisms each include an oil pan (9) surrounding at least part of the main drive gear (17);

and the single replaceable unit includes a removable cover (16) for said oil pan (9).

5. Machine according to claim 1, wherein the clutches (19) each comprise a disk clutch and a clutch operating mechanism (20) to control selective engagement and disengagement of the clutch.

6. Machine according to claim 5, wherein the traverse mechanisms each include an oil pan (9) surrounding at least part of the main drive gear (17);

the single replaceable unit includes a removable cover (16) for said oil pan (9);

and mounting pin means (21) to secure said cover (16) to the pan (9), said clutch operating mechanism (20) having an arm (33) located in interfering position with respect to said pin means (21) and formed to control said clutch to engaged position when the pin means is moved upon securing the cover (16) to the oil pan (9).

7. Machine according to claim 5, further comprising brake means (32) operated and controlled by said clutch operating mechanism (20) engageable with the drive element of the clutch when the clutch is disengaged and disabled when the clutch is engaged, to provide a positive stop for the driven clutch element (18) when the clutch is disengaged.

8. Machine according to claim 1, wherein the traverse mechanism includes an oil pan (9) surrounding at least part of the main drive gear (17) and;

the single replaceable unit includes a removeable cover (16) for said oil pan (9);

at least a portion of the traverse mechanism is mounted on said cover for removal therewith and includes the main drive; gear (17) and said traverse gearing means and wherein the respective main gear (18) located on the common drive shaft (2) is in engagement with the main drive gear (17) when the cover (16) is mounted on the oil pan (9) and said clutch (19) is engaged, said clutch selectively controlling transmission of power between said common drive shaft (2) and said main gear (18) and hence between said common drive shaft (2) and the traverse mechanism when the cover is mounted on the pan, the clutch permitting soft engagement of rotational transmission from the common drive shaft (2) to the main gear (18) of the individual spooling unit upon placement thereof.

9. Machine according to claim 1, wherein the clutch (19) includes an operating lever means (30, 33);

the traverse mechanism includes an oil pan (9) surrounding at least part of the main drive gear (17);

the single replaceable unit includes a removeable cover (16) for said oil pan (9);

and mounting pin means (21) are provided to secure said cover (16) to the pan (9) said mounting pin means being located to be placed in interfering position with respect to the operating lever means of the clutch (19) to control engagement and disengagement of said clutch in accordance with movement of the pin means (21), moving the pin means (21) to secure the removable cover effecting engagement of said pin means with the operating lever means (30, 33) of the clutch (19) to effect gradual engagement of the clutch as the pin means (21) is gradually moved to closing position, and to effect disengagement of the clutch when the pin means is moved to a position permitting removal of the removeable cover (16).

* * * * *